US009111446B2

(12) United States Patent
Pfeiffer et al.

(10) Patent No.: US 9,111,446 B2
(45) Date of Patent: Aug. 18, 2015

(54) METHOD FOR THE OUTPUT OF TEXT INFORMATION VIA A DISPLAY

(75) Inventors: Heinz-Werner Pfeiffer, Hohenhameln (DE); Ulrich Kersken, Diekholzen (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1531 days.

(21) Appl. No.: 10/590,769

(22) PCT Filed: Jan. 7, 2005

(86) PCT No.: PCT/EP2005/050066

§ 371 (c)(1),
(2), (4) Date: Jun. 8, 2007

(87) PCT Pub. No.: WO2005/083651

PCT Pub. Date: Sep. 9, 2005

(65) Prior Publication Data

US 2007/0252680 A1 Nov. 1, 2007

(30) Foreign Application Priority Data

Feb. 27, 2004 (DE) ..... 10 2004 009 459

(51) Int. Cl.
*G08G 1/09* (2006.01)
*G08G 1/0962* (2006.01)
*H04H 20/55* (2008.01)

(52) U.S. Cl.
CPC ..... *G08G 1/092* (2013.01); *G08G 1/0962* (2013.01); *H04H 20/55* (2013.01)

(58) Field of Classification Search
USPC ..... 345/156–172; 715/526–534, 261; 40/210; 340/438, 461, 692
See application file for complete search history.

(56) References Cited

U.S. PATENT DOCUMENTS

| | | | | |
|---|---|---|---|---|
| 5,724,644 | A | 3/1998 | Wassink et al. | |
| 5,757,268 | A * | 5/1998 | Toffolo et al. | 340/461 |
| 6,285,862 | B1 | 9/2001 | Rühl et al. | |
| 6,424,363 | B1 | 7/2002 | Matsuba et al. | |
| 6,748,682 | B1 * | 6/2004 | Sims | 40/210 |
| 7,168,039 | B2 * | 1/2007 | Bertram | 715/245 |
| 7,503,001 | B1 * | 3/2009 | Lekutai | 715/261 |
| 2004/1014842 | | 6/2004 | Drury et al. | |

FOREIGN PATENT DOCUMENTS

| | | |
|---|---|---|
| DE | 35 36 820 | 4/1987 |

* cited by examiner

*Primary Examiner* — Quan-Zhen Wang
*Assistant Examiner* — Yuk Chow
(74) *Attorney, Agent, or Firm* — Kenyon & Kenyon LLP

(57) ABSTRACT

Method for the output of text information via a display in a driver information system in a motor vehicle is provided, the display having a predetermined display capacity, the extent of the information to be output being adapted to the capacity of the display, and the text information or the information elements to be output being divided into at least two components each. The information or information elements are output to the full extent if allowed by the display capacity, and an abbreviation is output for at least one component of an item of information or an information element to be output if the capacity of the display is not sufficient for output of the complete information or a complete unit of information.

3 Claims, 1 Drawing Sheet

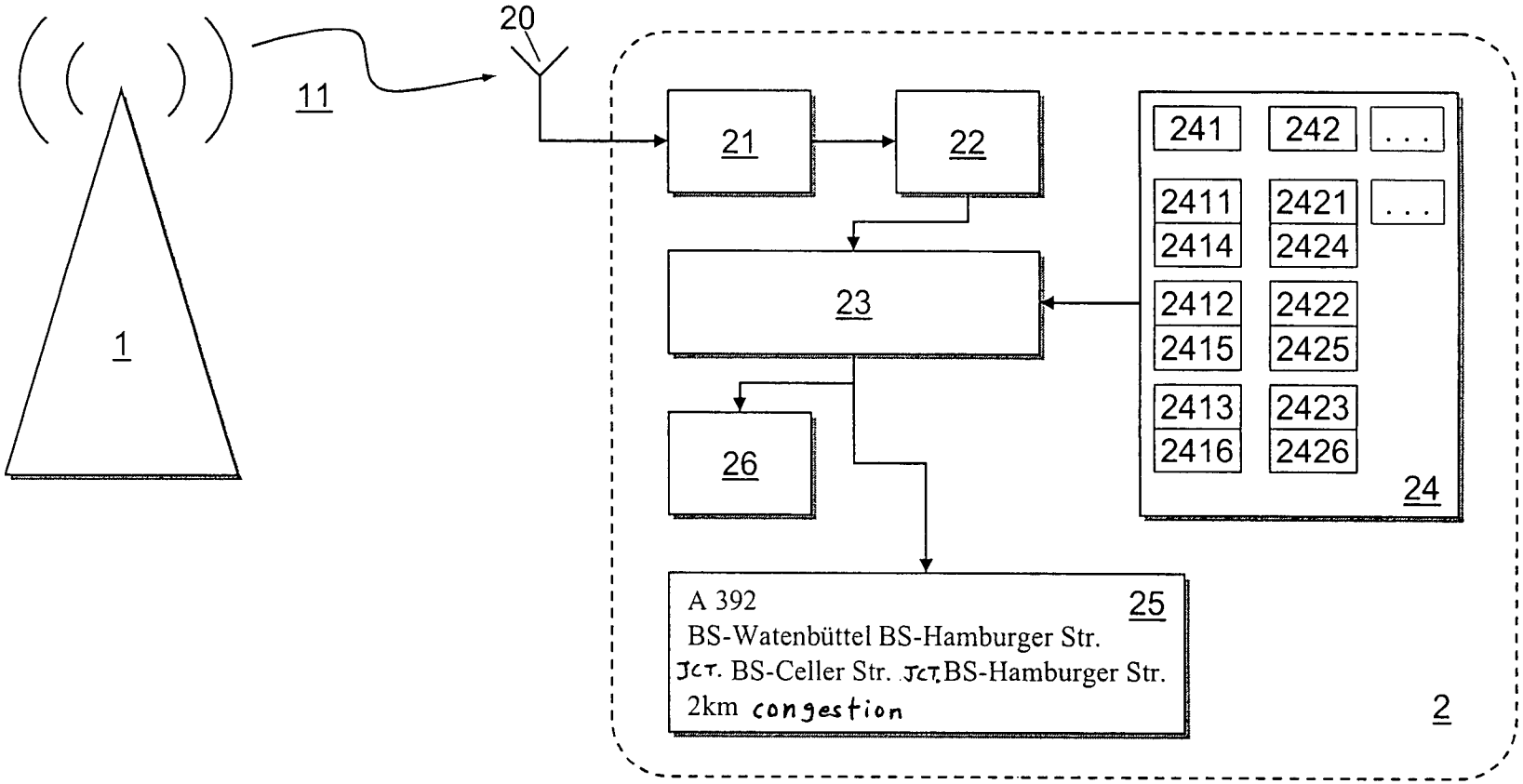
2
24
241
242
...
2411
2414
2421
2424
2412
2415
2422
2425
2413
2416
2423
2426
21
22
23
26
25
A 392
BS-Watenbüttel BS-Hamburger Str.
Jct. BS-Celler Str. Jct.BS-Hamburger Str.
2km congestion
20
11
1

METHOD FOR THE OUTPUT OF TEXT INFORMATION VIA A DISPLAY

FIELD OF THE INVENTION

The present invention relates to a method for output of text information via a display in a driver information system.

BACKGROUND INFORMATION

Driver information systems that output text information via a display are exemplified by receivers for traffic messages transmitted by radio, e.g., as described in published German patent document DE 35 36 820. Published German patent document DE 35 36 820 and ISO standards 14819-1, -2 and -3 describe, among other things, a method for encoded transmission of traffic messages in which a present message is broken down into elements at the transmitter end, the elements being encoded according to a catalog of standardized message elements and these codes then being transmitted. At the receiver end, the received codes are assigned to message elements stored in a table, and thus the traffic message composed of message elements assigned to the codes is displayed on the display. Memory media that are frequently replaceable such as CD-ROMs and DVDs, for example, are used for storing the decoding table.

Today's receivers for traffic messages of the type described here often have a display having a capacity of four to five lines, usually having at least 16 characters each. To be able to use the same decoding table, and thus the same data medium for decoding traffic message codes received via radio in a plurality of receivers, the message elements stored there are usually limited to a length of 16 characters. If the display capacity of such a driver information system is to be utilized optimally, decoding tables adapted to a particular display capacity of the particular device are needed at the present time.

SUMMARY

The method and the data medium according to the present invention have the advantage that despite the use of only a single database for text information to be output, the particular display capacity in each case is utilized optimally for a plurality of different types of equipment having different display capacities. Thus, essentially a single data medium is sufficient for a plurality of different types of driver information systems. Due to the associated high number of universal data media involved, it is possible to greatly reduce their manufacturing costs. In addition, the same data medium may also alternately be used for different driver information systems, e.g., in two vehicles of the same owner, multiple service vehicles of one employer, or different rental cars of one rental car company. Under some circumstances, this reduces the acquisition costs of the data media required for operation of the driver information systems.

BRIEF DESCRIPTION OF THE DRAWING

FIG. 1 shows a block diagram of a driver information system 2 according to the present invention for implementation of the method according to the present invention, the driver information system having an information data medium 24.

DETAILED DESCRIPTION

According to the present invention, all information to be output on a display of a device are broken down, e.g., on a driver information system for a motor vehicle, into at least two basic components, and an abbreviation for each basic component is provided in addition to a full text version and stored in a memory of the device, e.g., a CD-ROM. To adapt the information output to the display capacity of the display of the device, the particular abbreviation is then output instead of the full text version of an information component, if necessary. If information is made up of information elements, as described at the outset in the case of TMC traffic messages, for example, then for output of information made up of information elements, the breakdown may advantageously also be applied to the individual information elements, for which then, if necessary, full text versions or abbreviated versions of the information element components are output.

FIG. 1 shows a block diagram of a driver information system 2 according to the present invention for implementation of the method according to the present invention.

In the present case, driver information system 2 is a receiver for traffic messages transmitted by the TMC standard of ISO 14819-1, -2 and -3 within the RDS signal (Radio Data System) by radio without any restriction of general validity. These signals are transmitted by a transmitter 1 as part of a radio signal 11 over a VHF radio frequency by a conventional method. This frequency is modulated with the radio data signal, among other things. Radio signal 11 is picked up by a receiving antenna 20 of driver information system 2 and demodulated in a demodulator 21. The signal containing the actual information of interest, here applied at the output of demodulator 21, is sent to a decoder 22 for decoding the RDS-TMC signal. The signal containing the actual traffic message codes applied at the output of decoder 22 is sent to an output control unit 23.

Output control unit 23 has the function of adapting text information to be displayed on a display 25 to the capacity of display 25 and performing the display. In the case of driver information system 2 described here, the text information to be displayed is traffic messages obtained from the received RDS-TMC codes. Output control unit 23 here accesses a decoder table 24 in which information elements and/or message elements are assigned to the codes. Decoding table 24 is implemented in the form of a replaceable data medium, e.g., in the form of a CD-ROM here, which is accessed via a corresponding CD-ROM reader.

Data medium 24 contains the text information to be displayed on the display. Each information element on the data medium is divided into at least two components, preferably three components in the case of the present exemplary embodiment, namely a prefix, a body, and a suffix.

This division is explained below on the basis of the TMC location code list according to ISO 14819-3. Important locations along the most important traffic routes are stored as location codes in the TMC location code list. Highway entrances and exits, highway cloverleafs and intersections, rest sites, important node points of interstate highways, etc., are encoded using location codes. At least one street name and one place name are assigned to each of these location codes, the place name in particular being provided in text form on a display 25 of the device for output of the traffic message, or in acoustic form via a voice synthesizer unit 26 of the device. Such a location name is an information element in the sense of the present invention.

In the following three examples, the name of the encoded location as an information element is broken down into three components, i.e., prefix 2411, body 2412 and suffix 2413, these three components being stored on data medium 24, where they are assigned to particular location code 241. In addition, abbreviated components "shortened prefix" 2414, "shortened body" 2415, and "shortened suffix" 2416 are assigned to each of the three components and saved. Each of the three components is not necessarily present, nor is it necessarily required that a corresponding abbreviation is present for each component present. All components and their particular abbreviations are addressed jointly on the data medium through particular location code 241 and/or event code 242.

Three examples of the breakdown of one location name of the location code list into prefix, body, and suffix, as well as the particular abbreviated variant of the corresponding information element, are given below. In the examples, the symbol " " indicates that the component or the abbreviated variant is not provided.

1) "Berlin-Reinickendorf"
   Prefix="Berlin", Shortened Prefix="B-"
   Body="Reinickendorf" Shortened Body=" "
   Suffix=" " Shortened Suffix=" "
2) "Frankfurt am Main—Heddernheim"
   Prefix="Frankfurt am Main" Shortened Prefix="FfM-"
   Body="Heddernheim" Shortened Body=" "
   Suffix=" " Shortened Suffix=" "
3) "Braunschweig—Hamburger Strasse"
   Prefix="Braunschweig" Shortened Prefix="BS-"
   Body="Hamburger" Shortened Body=" "
   Suffix="Strasse" Shortened Suffix="Str."

Similarly, this breakdown is also provided for the event list according to ISO 14819-2, for example, in which event texts likewise assigned to event codes (events) are stored for text output on a display or for acoustic output. For example, the following text is assigned to event code 1392 (reference number 242): "Warning, a driver is approaching in the wrong lane! Do not pass! Caution on lanes going in both directions! We will report when the danger has passed." Such an event text also constitutes an information element in the sense of the present invention. According to the present invention, this is broken down on the data medium into the following components:

Prefix 2421="Warning"
Body 2422="A driver is approaching in the wrong lane! Do not pass! Caution on lanes going in both directions! We will report when the danger has passed."
Suffix 2423=" "

The abbreviations stored for this event text include:

Shortened prefix 2424="Warning."
Shortened body 2425="Driver in wrong lane"
Shortened suffix 2426=" "

The purpose of this division of information, i.e., information elements stored on the data medium, in This example event and location designators, is to adapt the information output to the display capacity of display 25. They may differ in the number of text lines available for output, as well as the number of characters per line and/or the font used for the display, namely proportional or non-proportional font, for example.

As a function of these parameters, display control unit 23 controls the following message text output, depending on the display capacity.

1) Message written out in full over four lines:
   On A 392
   Braunschweig-Watenbüttel in the direction of Braunschweig-Hamburger Strasse
   between Braunschweig-Celler Strasse and AS Braunschweig-Hamburger Strasse junctions
   2 km congestion
2) Abbreviated version:
   A 392
   BS-Watenbüttel BS-Hamburger Str.
   BS-Celler Str. jct. BS-Hamburger Str. jct.
   2 km congestion
3) Combination of abbreviated and unabbreviated name designators over five lines:
   On A 392
   BS-Watenbüttel in direction of BS-Hamburger Str.
   Braunschweig-Celler Str. jct.
   Braunschweig-Hamburger Str. jct.
   2 km congestion The text display of the information, namely traffic messages here, composed of multiple units of information, is displayed in sections, a separate line of display unit 25 being available for each unit of information in the present case. The individual units of information to be displayed include the street affected by a traffic holdup, the section of street affected, including a reference to the direction, the location of the traffic-relevant event limited by the nearby encoded locations, and the traffic-relevant event itself. Each unit of information mentioned above includes at least one information element, e.g., the unit of information "event" is formed from a single information element, whereas the "direction" as a unit of information includes three subelements, e.g., a first place name "Berlin-Wedding," a second place name "Berlin-Reinickendorf," and the direction formulated as "in direction of." Each line is made up of an XML character string by display control unit 23. A possible division of the display based on today's receivers of TMC traffic messages would be as follows, for example:

| | Description | Example |
|---|---|---|
| 1st line: | street affected | On A 110 |
| 2nd line: | direction information | Berlin-Wedding in direction of Berlin-Reinickendorf |
| 3rd line: | place information | Between Achterwehr and Melsdorf junctions |
| 4th line: | event | 2 km congestion |

Each line of display 25 is created from the XML character string generated by display control unit 23, taking into account the maximum line length displayable. If a proportional font is not used, the line length is determined from the maximum number of characters; otherwise, it is determined from the maximum number of pixels per line. These values, like the type of font used (proportional/not proportional), are stored for this purpose in each device in display control unit 23, or alternatively they may be checked by display control unit 23.

If the length of a unit of information, namely one line here, to be output currently exceeds the maximum line length displayable on display unit 25 of current driver information system 2, the line length may be abbreviated using the abbreviations of the prefix, body, and/or suffix that have been saved.

The line length may be abbreviated according to the following rules:

1) Replace the suffix by the shortened suffix if the shortened suffix contains at least one character.
2) Replace the prefix by the shortened prefix if the shortened prefix contains at least one character.
3) Suppress the suffix and the shortened suffix.
4) Suppress output of filler words.
5) Replace the body with the shortened body if the shortened body includes at least one character.
6) Line break 7) Terminate the second line after the maximum number of characters if the original line does not fit into two lines of display unit 25.

Preceding rules 1) through 7) are applied to each unit of information, i.e., to each individual line of information to be output in the present case, starting with the first rule in the order of ascending numbers. As soon as one of the rules has been satisfied, i.e., the line currently being considered is displayable on the display by applying the rules, the line and/or the unit of information is displayed without taking the other rules into account.

For the case of an alternative embodiment in which multiple units of information to be output are displayed in a joint line of display unit 5, it is also possible to provide for one of the rules to be first applied to a first unit of information of the line, then, if necessary to a second and, optionally, additional units of information of the line, before the additional rules are applied in the same way to the units of information of the line. Application of the rules to one or, if necessary, multiple units of information is terminated when the total length of the units of information to be depicted in the line is less than or equal to the available length of the line. It is thus possible to optimally utilize the available line length in each case.

If multiple units of information are output in a joint line, the above rules may also be applied essentially to the entire line in each case, i.e., jointly to multiple units of information. Alternatively, however, it is also possible in the display of multiple units of information in a line for the rules to be processed first for a first unit of information before being applied to a next unit of information of the line.

It is clear from rules 1) through 7) above that the body of the information or an information element is regarded as particularly essential for the output. Therefore, in the case of a necessary abbreviation of information components, the prefix and suffix may be shortened first, and optionally omitted entirely, before the body is output in abbreviated form. The sequence in which the rules are applied also indicates that the suffix is regarded as being of lesser significance in comparison with the prefix.

The rules stated above represent an example procedure. Nevertheless, different rules are also possible, as well as different sequences in applying the rules. For example, it is also possible, as an alternative, to first output the body in the abbreviated version before deleting the prefix and suffix if the abbreviated version of the body includes at least one character. In particular, it is also possible for the interpretation of the information components and their abbreviations on the data medium to be adapted to the rules applied and the order in which they are applied. For example, in the alternative order described here, it is possible for a comparatively detailed and self-explanatory version to be saved for the abbreviated body, whereas very short abbreviations are selected for the suffix in particular, but also the prefix, for example.

The present invention has been explained above based on the example of TMC traffic messages, which are usually made up of multiple units of information as described above, namely the street affected, the segment of street including direction information, the location of the event and the event itself, whereby in turn each unit of information includes at least one information element. However, this does not constitute a restriction of the present invention to the display of TMC messages nor to the data structure described here. Moreover, according to the present invention it is also possible for the information not to be made up of information elements but instead for the information itself to constitute the smallest unit of information. In this case, the breakdown into prefix, body, and suffix constituents according to the present invention is applied directly to the information and the display method is also implemented with these constituents.

Therefore, the present invention is not limited to receivers for encoded traffic messages, but instead may be applied to any information system having a text information output. Other possible examples of applications include vehicle navigation systems, for example, in which direction of travel information may be displayed in the form of text on a display. Other different applications are also possible and are within the scope of the present invention. Essentially, the present invention is applicable to any number of devices that generate information to be displayed on a display unit and may be applied to essentially any other information to be displayed.

According to one example embodiment of the present invention, in addition to the text information output via display 25, an acoustic output via a voice synthesizer system having a connected loudspeaker 26 may also be provided. For this case, for example, the display may be limited in its display capacity and thus the information may be output in a more or less greatly reduced form, whereas the information may be output acoustically in the complete version. To do so, the display control unit, as part of output control unit 23, also accesses the abbreviated versions of prefix, body, and suffix, while the output control unit for the acoustic output utilizes the full versions of prefix, body, and suffix for each item of information from data medium 24.

The present invention was explained above based on the example of a receiver for traffic messages transmitted over FM radio. However, this does not constitute a restriction of the present invention either to the origin or the type of messages or to the transmission method of medium if transmitted messages are involved. For example, a radio transmission via some other analog or digital radio may be considered for transmission of traffic messages according to the TMC standard; this would include, for example, the AM-RBDS which is widely used in the U.S. and resembles FM-RDS or DAB (Digital Audio Broadcasting), DVB (Digital Video Broadcasting), or the like. For example, a transmission of traffic messages in a point-to-point method may also be considered, e.g., via GSM (Global System for Mobile Communication) or UMTS mobile radio.

Furthermore, the information need not necessarily be output directly via a display of the receiver or of the device generating the messages. Instead, it is also possible for the information to be output via a separate display unit. For example, a handheld computer such as a PDA or the like may be connected as a separate display unit to the device generating the messages (or making them available), with the connection being over an infrared interface or a Bluetooth interface, and the information to be output by the device over the interface is shown on the display of the PDA. This assumes that the display capacity of the external display device, i.e., the PDA, for example, is known to the device delivering the information, e.g., a radio receiver having a TMC message decoder. This information may be requested by the radio receiver from the external display unit, e.g., via the Bluetooth interface.

What is claimed is:

1. A method for outputting text information to a driver of a vehicle via a display unit of a driver information system located inside the vehicle, the display unit having a predetermined display capacity, the method comprising:

providing text information to be output to the driver of the vehicle via the display unit of the driver information system located inside the vehicle, wherein the text information includes at least one information element, the at least one information element being divided into at least two component fields, and wherein the at least two component fields include at least an information body and at least one of an information prefix and an information suffix of the information element, and wherein at least one of the information body, information prefix and information suffix having a predetermined abbreviated equivalent; and adapting the text information to be output to the driver of the vehicle via the display unit of the driver information system located inside the vehicle, depending on the predetermined display capacity of the display unit of the driver information system located inside the vehicle, wherein text information outputted on the display unit of the driver information system located inside the vehicle includes: a) full representation of the at least one information element if the predetermined display is sufficient for the full representation; and b) the abbreviated equivalent of the at least one of the information body, information prefix and information suffix if the predetermined capacity is insufficient for full representation of the at least one information element;

wherein the text information to be output includes a plurality of information elements, and wherein for each information element, outputting one of: a) full representation of the information element if the predetermined display is sufficient for the full representation; and b) the abbreviated equivalent of the at least one of the information body, information prefix and information suffix if the predetermined capacity is insufficient for full representation of the at least one information element, and wherein each component of information element is displayed on a separate line of the display unit.

2. The method as recited in claim 1, wherein each component of information element has an abbreviated equivalent, and wherein the abbreviated equivalents are output.

3. A method for outputting text information to a driver of a vehicle via a display unit of a driver information system located inside the vehicle, the display unit having a predetermined display capacity, the method comprising:

providing text information to be output to the driver of the vehicle via the display unit of the driver information system located inside the vehicle, wherein the text information includes at least one information element, the at least one information element being divided into at least two component fields, and wherein the at least two component fields include at least an information body and at least one of an information prefix and an information suffix of the information element, and wherein at least one of the information body, information prefix and information suffix having a predetermined abbreviated equivalent; and adapting the text information to be output to the driver of the vehicle via the display unit of the driver information system located inside the vehicle, depending on the predetermined display capacity of the display unit of the driver information system located inside the vehicle, wherein text information outputted on the display unit of the driver information system located inside the vehicle includes: a) full representation of the at least one information element if the predetermined display is sufficient for the full representation; and b) the abbreviated equivalent of the at least one of the information body, information prefix and information suffix if the predetermined capacity is insufficient for full representation of the at least one information element;

wherein each of the information body, information prefix and information suffix having an abbreviated equivalent, and wherein the text information to be outputted is adapted hierarchically, whereby outputting of full representation the information body is given highest priority.

* * * * *